US005372664A

United States Patent [19]

Neidert et al.

[11] Patent Number: 5,372,664

[45] Date of Patent: Dec. 13, 1994

[54] CASTABLE DOUBLE BASE PROPELLANT CONTAINING ULTRA FINE CARBON FIBER AS A BALLISTIC MODIFIER

[75] Inventors: Jamie B. Neidert, Brigham City, Utah; Robert E. Askins, Huntsville, Ala.

[73] Assignee: Thiokol Corporation, Ogden, Utah

[21] Appl. No.: 8,405

[22] Filed: Jan. 13, 1993

Related U.S. Application Data

[63] Continuation-in-part of Ser. No. 833,438, Feb. 10, 1992, abandoned.

[51] Int. Cl.[5] ..... C06B 45/10

[52] U.S. Cl. ..... 149/19.8; 149/50

[58] Field of Search ..... 149/19.8, 50

[56] References Cited

U.S. PATENT DOCUMENTS

| | | | |
|---|---|---|---|
| 3,009,802 | 11/1961 | Lyons | 52/23 |
| 3,392,068 | 7/1968 | Knowles | 149/21 |
| 3,532,567 | 10/1970 | Winkler et al. | 149/19 |
| 3,711,344 | 1/1973 | Pierce | 149/19 |
| 3,860,462 | 1/1975 | Sayles | 149/19.8 |
| 3,876,477 | 4/1975 | Eldridge et al. | 149/19.3 |
| 3,921,394 | 11/1975 | Tannenbaum | 60/217 |
| 3,925,124 | 12/1975 | Tannenbaum | 149/74 |
| 3,943,017 | 3/1976 | Wells | 149/19.8 |
| 4,072,546 | 2/1978 | Winer | 149/19.8 |
| 4,462,848 | 7/1984 | Elrick | 149/19.92 |
| 4,689,097 | 8/1987 | Jones | 149/21 |
| 4,812,179 | 3/1989 | Sayles | 149/19.2 |
| 4,903,604 | 2/1990 | Blewett et al. | 102/364 |

*Primary Examiner*—Edward A. Miller

*Attorney, Agent, or Firm*—Madson & Metcalf

[57] ABSTRACT

Propellant formulations are provided which include non-toxic burn rate modifiers. In order to produce a usable propellant formulation, it is necessary to control the burn rate of the propellant. Failure to adequately control the propellant burn rate often results in unacceptable performance of the propellant. It has been found that carbon fibers are capable of modifying the burn rate of propellants without resorting to lead as a burn rate additive. Accordingly, the use of from about 0.5% to about 6.0% carbon fibers is taught as effective burn rate modifiers in propellants, in order provide non-toxic means for modifying the propellant burn rate.

12 Claims, 1 Drawing Sheet

CASTABLE DOUBLE BASE PROPELLANT CONTAINING ULTRA FINE CARBON FIBER AS A BALLISTIC MODIFIER

Related Applications

This application is a continuation-in-part of Applicants' copending application Ser. Number 07/833,438, filed Feb. 10, 1992, now abandoned, and entitled "Burn Rate Modification of Solid Propellants With Carbon Fiber," which application is incorporated herein by this reference.

BACKGROUND

1. The Field of the Invention

The present invention is related to methods and compositions for modifying the burn rate of solid rocket motor propellants, without the addition of expensive, toxic or polluting materials, such as lead. More particularly, the present invention is related to the use of carbon fiber alone to modify the burn rate of solid rocket motor propellants.

2. Technical Background

In the manufacture of solid rocket motors, several components have been found to be required. First there must be an adequate rocket motor case. The rocket motor case forms the exterior of the rocket motor and provides the essential structural integrity for the rocket motor. The rocket motor case is conventionally manufactured from a rigid, yet durable, material such as steel or filament wound composite.

Placed within the interior of the rocket motor case is the propellant grain. The propellant forming the grain is conventionally burned to form thrust within the interior of the rocket motor case. The formation of hot gases upon burning of the propellant, and the subsequent exit of those gases through the throat and nozzle of the case provide the thrust to propel the rocket motor.

There are two major classes of propellants used in conventional applications. These include solid propellants and liquid propellants. Solid propellants are used extensively in the aerospace industry. Solid propellants have developed as the preferred method of powering most missiles and rockets for military, commercial, and space applications.

Solid rocket motor propellants have become widely accepted because of the fact that they are relatively simple to manufacture and use, and they have excellent performance characteristics. Furthermore, solid propellant rocket motors are generally more simple than liquid fuel rocket motors. For all of these reasons, it is found that solid rocket propellants are very reliable and economical.

In some applications, it is important that the rocket motor perform with reduced or eliminated smoke output. For example, in tactical rocket motors, the production of smoke causes a number of disadvantages. The smoke produced may obscure the vision of pilots or drivers of a craft or vehicle firing the tactical rocket. In addition, the production of smoke makes tracking the source of the motor easier, a serious disadvantage during military operations, especially for ground and helicopter launched systems.

An important consideration in solid propellants, including minimum smoke propellants, is means for controlling the burn rate of the propellant, without significantly adding to the smoke output of the propellant. At the same time it is important that the propellant burn at a controlled and predictable rate without performance loss. If the burn rate of the propellant can be controlled it is possible to assure proper operation of the rocket motor, or other similar device.

If the propellant achieves an excessively high burning rate, the pressure created within the casing may exceed the design capability of the casing, resulting in damage or destruction to the device. If the propellant does not develop a sufficient burn rate, there may not be sufficient thrust to propel the rocket motor over the desired course.

Accordingly, it is conventional in the art to add materials to the propellant to control the burn rate of the propellant. Such materials are often referred to as burn rate modifiers. Burn rate modifiers are generally added in order to control the burning rate and pressure exponent of the propellant to lower the pressure exponent or to cause a "plateau" at an operable level. Plateau burning behavior (sometime referred to as platonization) is typified by a zero, or very low, exponent over a 700 to 3000 psig range in a logarithmic plot of the burning rate versus pressure. Conversely, a mesa burning is typified by a zero slope at some point followed by a negative burning rate at some higher pressure. When burn rate is plotted as a graph of burn rate (for example, in inches per second) on the Y-axis and pressure in pound per square inches on the X-axis, the plateau effect results in a flattening of the burn rate curve to a slope more parallel with the X-axis. This plateau effect (platonization) is desirable in order to achieve a relatively constant burn rate pressure output over a chosen pressure ranges.

In order to achieve the plateau effect described above, it has been common practice to add relatively toxic metals to the propellant. For example, lead is perhaps the most widely used burn rate modifier for certain classes of propellants. Lead, however, is known to be a hazardous, toxic, and polluting metal. Concern with lead pollution in society as a whole is on the rise, and serious health problems are known to be associated with lead poisoning and lead pollution. As a result, concern with lead in the preparation and use of propellants is high, and it is presently preferred that lead be eliminated as a component of solid propellants. The primary concern has been exhibited by the United States Army because of the exposure of personnel to missile exhaust.

Accordingly, it would be a significant advancement in the art to provide methods and compositions for modifying propellant burn rates which avoided some of the significant toxicity problems encountered with conventional burn rate modifiers. It would be a significant advancement in the art to provide methods and compositions for modifying burn rates in propellants which did not rely on toxic, hazardous, or polluting burn rate additives such as lead oxide. It would be a further advancement in the art to provide such propellants which produced a minimum of smoke output when burned. It would be another advancement in the art to provide propellant compositions which are generally insensitive.

Such methods and compositions are disclosed and claimed herein.

BRIEF SUMMARY AND OBJECTS OF THE INVENTION

The present invention is related to methods and compositions for modifying the burn rate of solid rocket motor propellants, without the addition of expensive, toxic, hazardous, or polluting materials, such as lead and copper. More particularly, the present invention is related to the use of carbon fibers alone, to modify the burn rate of a solid rocket motor propellant. The addition of carbon fibers has been found to be effective in modifying the burn rate of certain propellants in order to provide a more usable and controllable propellant product.

The present invention has been found particularly effective in controlling the burn rate of propellants containing a combination of nitrocellulose/nitrate esters and ammonium nitrate. Such propellants are widely used as solid rocket motor propellants.

A propellant of this general type may be formulated as follows:

| Material | Percentage Range |
|---|---|
| Ammonium Nitrate | 20–25 |
| Nitrocellulose | 15–17 |
| BTTN | 39–41 |
| TMETN | 13–15 |

BTTN and TMETN are nitrate esters. These abbreviations stand for 1,2,4 butanetrioltrinitrate (BTTN) and trimethylolethane trinitrate (TMETN). This type of propellant is also known to be relatively low in smoke output in smoke chamber tests and, therefore, is desirable for uses where minimum smoke is a significant benefit. In addition, formulations within the ranges set forth above are found to be relatively insensitive to accidental ignition (32 cards in the NOL card gap test).

The present invention is particularly adaptable to propellants of this type which are often referred to as "double base" propellants. Double base propellants have been widely used for a long period of time. The term "double base" merely indicates that (typically nitrocellulose (NC) and nitroglycerin (NG) or other nitrate esters). One typical method of NG incorporation in this system is solventless, whereby the NG is mixed with an aqueous slurry of NC, filtered, then rolled or pasted into a powder while heating. Another method incorporates solvents such as acetone. A final method employs solid NC in a rocket chamber which is then swelled with NG or nitrate esters to then form the grain.

The castable (pourable) double base ("CDB") discussed herein requires none of these difficult procedures. The castable double base propellant is readily cast in any device after only one mix procedure or cycle. The mix cycle involves the vacuum mixing of a preblend containing NC, TMETN, BTTN, and MNA. Desired ballistic additives are incorporated, followed by the addition of curing agents, further mixing, and vacuum casting of samples.

While such propellants are widely used as rocket motor propellants, in the absence of burn rate modifiers these propellant compositions are generally found to have high burn rates/pressure exponents which render them unusable. As discussed above, the term "pressure exponent" means the slope of a logarithmic plot with burn rate in inches per second on the Y axis and pressure in pounds per square inch on the X axis. Thus, in the absence of burn rate modifiers, it is found that the burn rate exponent is relatively constant and does not level out during operation. In addition, it is generally found that a rocket motor propellant having a pressure exponent (n) where n is $\geqq 1$ will not operate in a stable manner.

In order to deal with this problem, the present invention teaches the addition of a non-toxic, non-hazardous, and non-polluting burn rate modifier to nitrate ester/ammonium nitrate propellants. This burn rate modifier is ultra fine carbon fibers. While carbon has been used to augment propellant burning rates in combination with other ballistic additives, this invention demonstrates the significant burning rate modification achieved in minimum smoke propellants with carbon alone (i.e. without the use of other toxic and hazardous materials). It is found the addition of from about 0.5% to about 6.0%, and more preferably from about 1.0% to about 3.0%, carbon fibers to propellants of this type results in a much more controllable and usable burn rate over a significant period of operation. This is to be distinguished from the addition of carbon in other forms to the propellant formulation.

It is, therefore, a primary object of the present invention to provide methods and compositions for modifying propellant burn rates which avoid problems encountered with conventional burn rate modifiers.

More particularly, it is an object of the present invention to provide a burn rate modifier which is not based on lead or similar toxic materials.

It is a related object of the invention to provide methods and compositions for modifying burn rate which do not rely on expensive, toxic, hazardous, or polluting burn rate additives.

It is a further object of the invention to provide such propellants which produce minimum smoke output when burned.

It is another object of the present invention to provide propellants which are generally insensitive to accidental ignition.

These and other objects and advantages of the invention will become apparent upon reading the following detailed description and appended claims, and upon reference to the accompanying drawings.

BRIEF DESCRIPTION OF THE DRAWINGS

In order that the manner in which the above-recited and other advantages and objects of the invention are obtained, a more particular description of the invention briefly described above will be rendered by reference to specific data presented in the appended drawing. Understanding that this drawing depicts only information for typical embodiments of the invention and is not, therefore, to be considered limiting of its scope, the invention will be described and explained with additional specificity and detail through the use of the accompanying drawing in which.

DETAILED DESCRIPTION OF THE PREFERRED EMBODIMENTS

Figure 1:
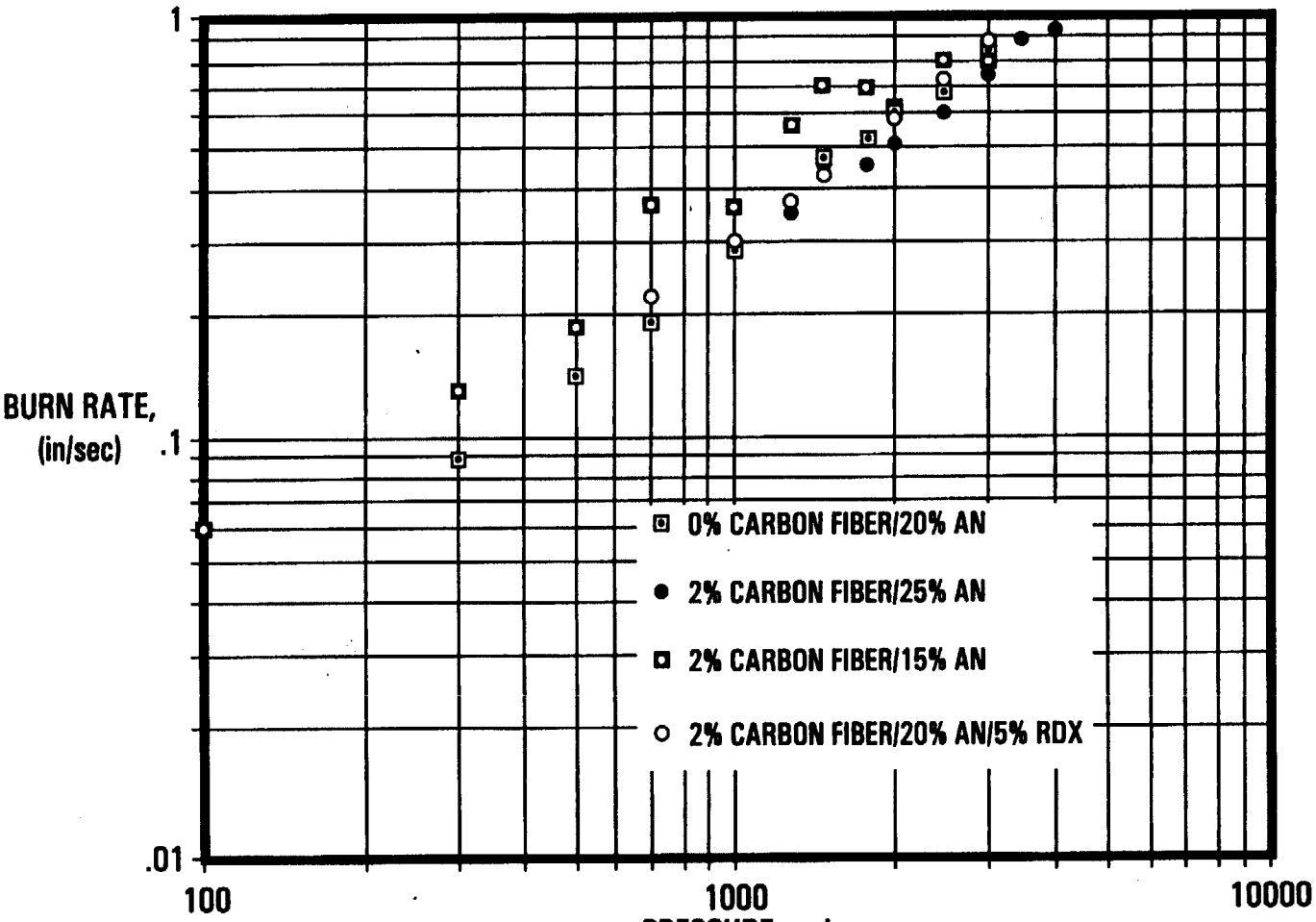
FIG. 1 is a graph plotting burn rate data obtained from three propellant compositions within the scope of the present invention, plus data obtained from a control composition.

As mentioned above, the present invention is related to methods and compositions for modifying the burn rate of solid rocket motor propellants, without the addition of expensive, toxic, hazardous, or polluting materials, such as lead and copper and their related compounds.

Specifically, the present invention is related to the use of carbon fibers alone to modify the burn rate of solid rocket motor propellants. In order to modify burn rate, carbon fibers may be added to the composition. Carbon fibers within the propellant composition are believed to control surface disruption. This results in controlled surface burning of the propellant. Thus, it is possible to modify the burn rate of the propellant composition.

The carbon fibers added to the propellant formulation may have a relatively wide range of fiber sizes. For example, carbon fibers having fiber sizes in the range of from about 0.05μ to 10μ in diameter and from about 0.5 μ to about 5,000 μ in length fall within the scope of the present invention.

With propellants falling within the scope of the present invention it is presently preferred to add carbon fibers to constitute from about 0.5% to about 6.0%, by weight, of the total propellant formulation. More particularly, it is found that propellants having from about 1.0% to about 3.0% carbon fibers produce propellants having good performance characteristics.

As mentioned above, the present invention is particularly useful when used with propellant compositions based upon a combination of nitrocellulose/nitrate esters and ammonium nitrate. It should be appreciated, however, that the present invention will also be found beneficial with other types of propellants such as ammonium perchlorate-based, cross-linked double base (XLDB), minimum smoke (nitrato plasticized) propellants, as well as CDB formulations without ammonium nitrate.

A typical formulation falling within the scope of the present invention may have the following ingredients, in the following percentages (by weight):

| Material | Percentage Range |
|---|---|
| Ammonium Nitrate | 20–25 |
| Carbon Fibers (0.1μ dia.) | 1.0–3.0 |
| Nitrocellulose | 15–17 |
| Nitrate Esters | 52–56 |
| including: | |
| BTTN | 39–41 |
| TMETN | 13–15 |
| N-methylnitro aniline (MNA) | 0–1.0 |

Propellants falling within the scope of the present invention are found to provide excellent burn rate control. In particular, formulations within the scope of the invention result in burning rate v. pressure curves which exhibit a significant "plateau" as well as mesa characteristics. As mentioned above, the plateau effect provides the ability to control the pressure produced by burning the propellant, and allows one to construct a propellant grain which is suitable for use in a rocket motor casing.

In addition, it is found that the formulations of the present invention exhibit other beneficial characteristics. For example, the propellants of the present invention are generally low smoke. This is a significant benefit, especially when the propellant is to be used in a tactical rocket motor. Low smoke propellants make it more difficult to precisely locate the point from which the rocket motor was fired. In addition, low smoke characteristics assure that visibility is not obstructed at the point of firing.

Furthermore, the propellants are relatively insensitive (≦70 cards in the NDL card gap test). This increases the safety of the propellants and provides the ability to use the propellants with confidence, even in hazardous environments such as military operations. Such insensitive propellants are much less likely to be accidently detonated.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

EXAMPLES 1–2

In this Example three (3) propellants within the scope of the present invention where prepared, burned, and characterized. In addition, one control was prepared without the addition of carbon or carbon fibers. The propellants had the following weight percentage compositions:

| Composition #1 | |
|---|---|
| Material | Percentage |
| Nitrocellulose | 15.81 |
| BTTN | 40.39 |
| TMETN | 13.43 |
| MNA | 2.00 |
| TMXDI | 1.35 |
| Triphenyl bismuth (TPB) | 0.02 |
| Ammonium nitrate | 25.00 |
| Carbon fiber | 2.00 |
| Legend in FIG. 1 | ♦ |

(Carbon Fiber Size-0.1μ diameter by various lengths)

Nitrocellulose (NC) binder, BTTN, TMENTN and MNA are incorporated into the propellant in the form of a preblend as described above. The preblend was prepared by dissolving, or swelling, the NC in acetone and, after thoroughly mixing the ingredients, removing all of the solvents. This resulted in a lacquer preblend, TMXDI is employed as a curing agent to cross link the NC binder.

| Material | Percentage |
|---|---|
| Composition #2 | |
| Nitrocellulose | 18.35 |
| BTTN | 46.19 |
| TMETN | 15.41 |
| MNA | 1.63 |
| TMXDI | 1.41 |
| TPB | 0.02 |
| Ammonium nitrate | 15.00 |
| Carbon fiber | 2.00 |
| Legend in FIG. 1 | ■ |
| (Carbon Fiber Size-0.1μ diameter by various lengths) | |
| Composition #3 | |
| Nitrocellulose | 15.81 |
| BTTN | 40.39 |
| TMETN | 13.43 |
| MNA | 2.00 |
| TMXDI | 1.35 |
| TPB | 0.02 |
| Ammonium nitrate | 20.50 |
| Carbon fiber | 2.00 |
| RDX | 5.00 |
| Legend in FIG. 1 | ◊ |
| Control (baseline) | |
| Nitrocellulose | 16.25 |
| BTTN | 41.57 |
| TMETN | 13.81 |
| MNA | 2.00 |

-continued

| Material | Percentage |
|---|---|
| TMXDI | 1.35 |
| TPB | 0.02 |
| Ammonium nitrate | 25.00 |
| Legend in FIG. 3 | □ |

It was found that the formulations set forth above produced acceptable low-smoke propellants.

Strands of the propellant formulations, along with the control (baseline), were burned and the burning rate of the propellant formulations was plotted against the pressure. The results of that plot are set forth in FIG. 1. It can be seen from FIG. 1 that the slope of the plots for the propellants within the scope of the invention show regions of low exponent (plateau and mesa behavior), whereas the plot for the control is essentially a straight line. A plateau response (zero exponent) is observed from 1300 to 1500 psi in the 15% AN formulation shown in FIG. 1. A mesa (negative exponent) is obvious from 1500 to 1800 psi in the same formulation.

A propellant such as the control would not be useable for most solid rocket motor applications, whereas the propellants of the present invention would be acceptable. This indicates that the burning rates of the propellants are effectively modified by the addition of carbon fibers. The burn rate v. pressure is well within the range required for a usable propellant formulation. In addition, these data indicate that acceptable propellants are formed with carbon fibers in the 1% to 3% range.

EXAMPLE 3

In this Example a propellant within the scope of the present invention is prepared. The propellant has the following weight percentage compositions:

| Composition | |
|---|---|
| Material | Percentage |
| Ammonium Nitrate | 25.0 |
| Preblend/curing agent | 74.0 |
| Carbon Fiber | 1.0 |

It would be expected that the formulation set forth above produces acceptable low-smoke propellants having an acceptably modified burn rate.

EXAMPLE 4

In this Example a propellant within the scope of the present invention is prepared. The propellant has the following weight percentage compositions:

| Composition | |
|---|---|
| Material | Percentage |
| Ammonium Nitrate | 25.0 |
| Preblend/curing agent | 72.0 |
| Carbon Fiber | 3.0 |

It would be expected that the formulation set forth above produces acceptable low-smoke propellants have an acceptably modified burn rate.

Summary

In summary, the present invention provides methods and compositions for controlling the burn rate of solid rocket motor propellants. More particularly, the burn rate of nitrate ester/ammonium nitrate propellants have been shown to be controlled by the addition of from about 0.1% to about 3.0% carbon fiber.

By formulating the propellants as taught by the present invention it is possible to avoid some of the significant problems encountered with conventional burn rate modifiers. In particular, the present invention provides compositions and methods for modifying burn rate without the use of lead, copper, or similar materials. The burn rate is modified by the addition of carbon fiber, which is not toxic, hazardous, or polluting.

The propellant formulation produced is a minimum smoke propellant which is also generally insensitive. Thus, the major objects of the present invention are met by the compositions and methods of the present invention.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A solid propellant having a modified burn rate consisting essentially of:
   from about 10% to about 25% ammonium nitrate;
   from about 15% to about 17% nitrocellulose;
   from about 52% to about 56% of one or more nitrate ester plasticizers;
   from about 0.5% to about 6.0% carbon fiber wherein said carbon fiber modifies the burn rate of the propellant composition such that a portion of the burn rate versus pressure curve for said propellant has a slope less than or equal to approximately 1.0.

2. A solid propellant having a modified burn rate as defined in claim 1 wherein said nitrate esters are selected from the group consisting of 1,2,4 butanetriol-trinitrate and trimethylolethane trinitrate.

3. A solid propellant having a modified burn rate as defined in claim 1 consisting essentially of from about 0.5% to about 3.0% carbon fiber.

4. A solid propellant having a modified burn rate as defined in claim 1 further consisting essentially of up to about 1.0% N-methylnitro aniline (MNA).

5. A solid propellant having a modified burn rate as defined in claim 1 wherein said carbon fiber has a fiber size in the range of from about 0.1$\mu$ to about 0.25$\mu$ diameter and from about 100$\mu$ to about 5,000$\mu$ in length.

6. A modified burning rate solid propellant comprising a solid propellant matrix consisting essentially of from about 10% to about 25% ammonium nitrate; from about 15% to about 17% nitrocellulose; from about 52% to about 56% of one or more nitrate ester plasticizers; and from about 0.5% to about 6.0% burn rate modifier added thereto, said burn rate modifier consisting essentially of carbon fiber, wherein a sufficient quantity of carbon fiber is added to produce a region of low exponent in the burning rate v. pressure curve of the propellant.

7. A modified burning rate solid propellant as defined in claim 6 consisting essentially of from about 1.0% to about 3.0% burn rate modifier.

8. A modified burning rate solid propellant as defined in claim 6 wherein said carbon fiber has a fiber size in the range of from about 0.1μ to about 0.25μ in diameter and from about 100μ to about 5,000μ in length.

9. A method for modifying the burning rate of a solid nitrate ester/ammonium nitrate propellant comprising the step of:

formulating a propellant consisting essentially of from about 10% to about 25% ammonium nitrate; from about 15% to about 17% nitrocellulose, from about 52% to about 56% nitrate ester; from about 0.5% to about 6.0% carbon fiber;

wherein carbon fiber is added to the propellant composition in the absence of other burn rate modifiers and wherein the carbon fiber modifies the burn rate versus pressure curve for said propellant such that a portion of the curve has a slope less than or equal to approximately 1.0.

10. A method for modifying the burning rate of a solid nitrate ester/ammonium nitrate propellant as defined in claim 9 wherein carbon fiber is added such that it comprises from about 0.1% to about 7.0% by weight of the propellant.

11. A method for modifying the burning rate of a solid nitrate ester/ammonium nitrate propellant as defined in claim 9 wherein carbon fiber is added such that it comprises from about 1.0% to about 3.0% by weight of the propellant.

12. A method for modifying the burning rate of a solid nitrate ester/ammonium nitrate propellant as defined in claim 9 wherein said carbon fiber has a particle size in the range of from about 0.1μ to about 0.25μ in diameter and from about 100μ to about 5,000μ in length.

* * * * *